US005979432A

United States Patent [19]

Grove

[11] Patent Number: 5,979,432

[45] Date of Patent: Nov. 9, 1999

[54] PORTABLE GAS HEATER

[76] Inventor: David F. Grove, 544 Glass La., White City, Oreg. 97503

[21] Appl. No.: 09/232,587

[22] Filed: Jan. 19, 1999

[51] Int. Cl.[6] ..... F24C 5/00

[52] U.S. Cl. ..... 126/92 B; 126/93; 431/343; 431/344

[58] Field of Search ..... 126/29, 30, 92 R, 126/92 B, 92 AC, 92 C, 93, 40, 50, 276, 286; 431/343, 344

[56] References Cited

U.S. PATENT DOCUMENTS

| | | | |
|---|---|---|---|
| 1,987,603 | 1/1935 | Claesson | 126/93 |
| 3,029,802 | 4/1962 | Webster | 126/93 |
| 3,139,879 | 7/1964 | Bauer et al. | 126/92 B |
| 3,179,156 | 4/1965 | Weiss et al. | 126/92 B |
| 5,632,265 | 5/1997 | Koziel | 126/30 |

FOREIGN PATENT DOCUMENTS

| | | | |
|---|---|---|---|
| 559179 | 3/1957 | Italy | 126/92 B |

*Primary Examiner*—James C. Yeung
*Attorney, Agent, or Firm*—James D. Givnan, Jr.

[57] ABSTRACT

A portable space heater includes a base suitable for insertion into a cup holder of a vehicle or other inhabitable strcuture. The base carries a post on which fuel containers are carried. A holder at the upper end of the post includes a clamp which retains a burner assembly in place with a heat reflector vertically spaced upward from the base. Fuel lines and suitable valving and fittings provide a controlled fuel flow to the heat reflector.

9 Claims, 1 Drawing Sheet

PORTABLE GAS HEATER

BACKGROUND OF THE INVENTION

The present invention pertains generally to portable heaters fired by a self-contained pressurized gas supply. In use today are portable, gas fired heaters for use by outdoorosmen, workmen, etc., to serve as space heaters in small areas. To the extent known such gas fired heaters are intended for use in a closed space, as for example, a small building, tent, hunting blind, etc.

Such heaters are not readily adapted or intended for use in vehicles, as for example, golf carts, as they lack stability to remain upright during travel. Small vehicles such as golf carts are used throughout the year in all types of weather but to the extent known lack heating devices for convenient installation and subsequent removal from the vehicle. While convenient installation and removal are highly desirable features of a portable heater, stable and secure support must be provided to avoid risk to the user.

SUMMARY OF THE PRESENT INVENTION

The present invention is embodied within a portable gas fired heater with a heater base rapidly engageable with existing support structure.

The present heater includes a base intended for inserted engagement with a receptacle in an enclosure intended primarily for another use, as for example, receiving a beverage cup and commonly termed a cup holder. The base of the heater is configured to insertably engage cup holder structure in a manner securing the heater against tipping or separation to permit the heater to be utilized in vehicles including those for traversing uneven terrain, as for example, golf carts or other small vehicles used in recreational activities.

Important objectives include the provision of a portable heater including a base readily attachable to existing vehicle structure; the provision of a portable heater attachable to and removable from vehicle structure without the aid of tools; the provision of a portable heater including a cylindrical base insertable within a receptacle intended for reception of a beverage container; the provision of a portable heater wherein components are supported on a post structure in a secure manner to withstand forces incurred in the travel of a vehicle over uneven terrain.

DETAILED DESCRIPTION OF THE PREFERRED EMBODIMENTS

Figure 1:
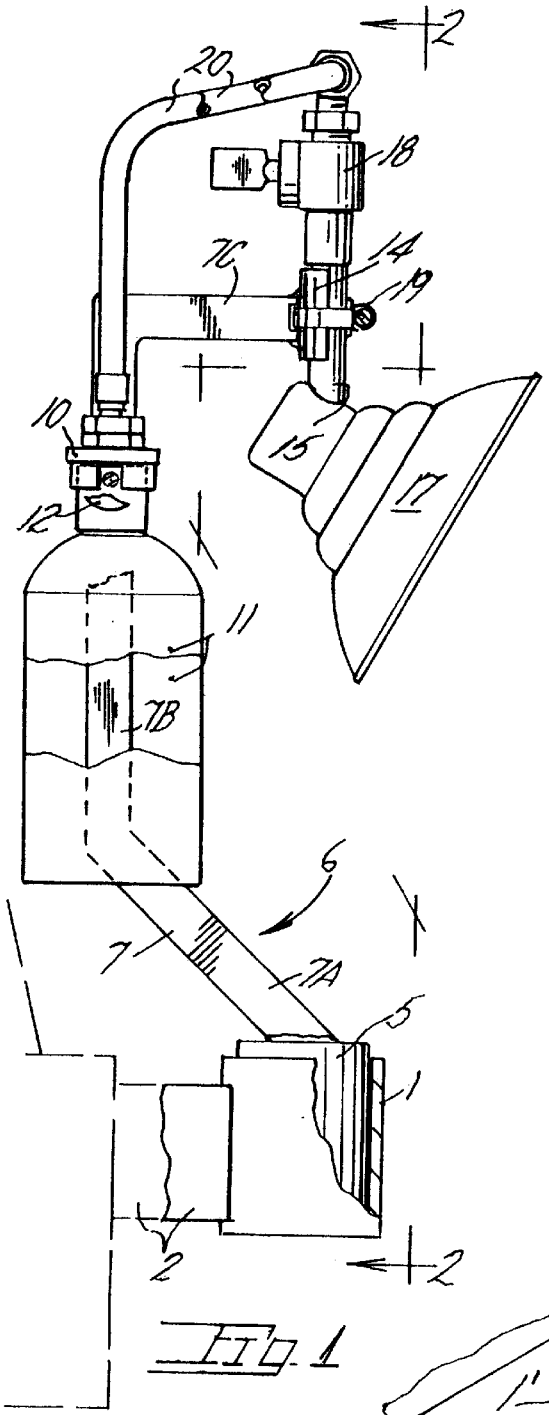
FIG. 1 is a side elevational view of the present heater in place within a receptacle.
Figure 2:
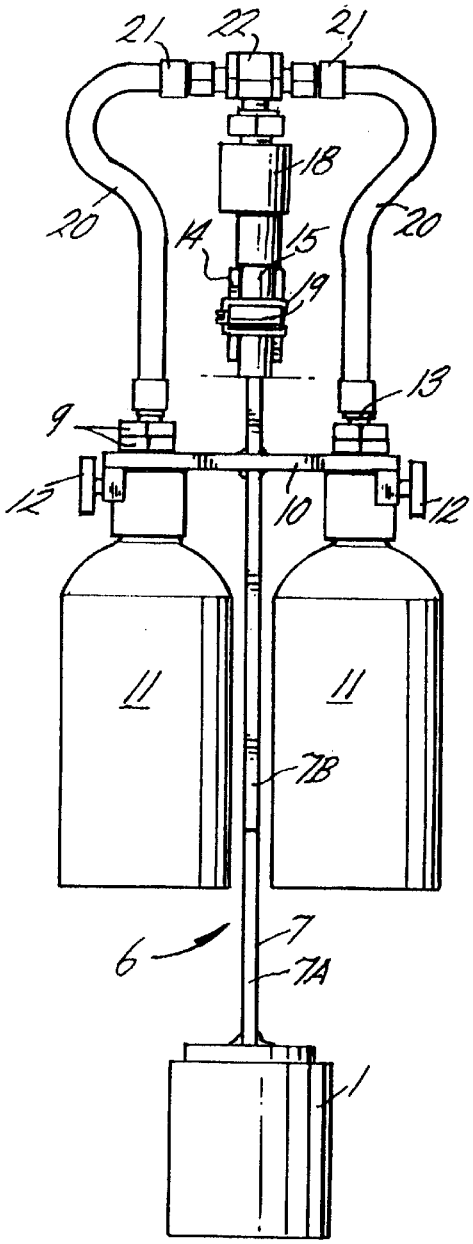
FIG. 2 is an elevational view of FIG. 1 taken along irregular line 2—2 of FIG. 1.

With continuing attention to the drawings wherein applied reference numerals indicate parts similarly hereinafter identified, the reference numeral 1 indicates a receptacle attached at 2 to a stationary structure, as for example, a portion of a vehicle. Receptacle 1 may take other forms than that shown but are generally circular and sized for the snug reception of beverage containers such as glasses, cups, beverage cans, etc.

With attention now to the portable heater, an elongate heater base at 5 is shown in inserted engagement with receptacle 1 of generally corresponding shape. Base 5 may be cylindrical, but in some applications could be of elongate, polygonal shape. Further, base 5 could include a shoulder about its upper perimeter.

A support structure is indicated generally at 6 and includes a post 7 preferably of angulated configuration having an inclined segment 7A, an upright segment 7B and a horizontal segment 7C. Such a configuration may vary to suit specific installations but should address locating a later described heat reflector at a safe distance from the user. With continuing attention to support structure 6, carrier means 10 thereon and shown as a bracket serves to carry a source of compressed gas shown as a propane container at 11 of the type commonly used in small gas barbecues. Such containers are also used in small gas heaters and have a valve control at 12 and further include a threaded outlet at 13 which receives jam nuts 9 for container securement to bracket 10 in a removable manner. Horizontal segment 7C terminates outwardly in a holder shown as a semi-circular sleeve 14 welded to the segment end to receive a discharge pipe 15 of the burner assembly later described. An adjustable threaded clamp is at 19.

A heat reflector 17 of a burner assembly is served by pipe 15 and an adjustable flow control valve 18. In the preferred form of the present heater valve 18 is fed by either of two containers by conduits 20 provided with suitable couplings 21 and serving a T fitting at 22 on valve 18 to permit supplying fuel from either or both containers 11.

Figure 3:
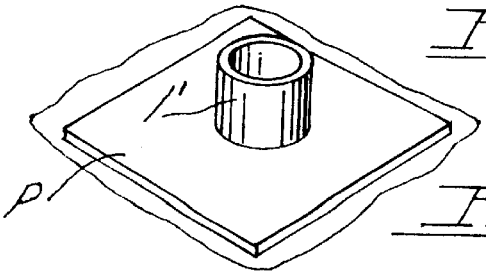
FIG. 3 is a perspective view of a platform for alternative installation of the invention.

In FIG. 3 I show a receptacle at 1' as fixed in place on a platform p for table or floor placement for alternative installation of the present heater.

Use of the present portable gas heater is believed to be apparent from the foregoing description. The heater is highly practical, one purpose being for the heating of rented golf carts as it may be conveniently carried to the cart and installed as well as removed at the end of a golf game. As it does not become a permanent component of the cart it is believed to not affect the cart warranty or present a risk of liability to a cart manufacturer as the portable heater would be the property of the cart renter. In a broader sense the present heater could be removably mounted in a correspondingly shaped receptacle in a manner achieving convenient installation and removal for heating various other types of inhabitable structures.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A gas fired space heater for detachable engagement with a vehicle mounted cup holder and comprising a base for inserted engagement with the holder, a post structure integral at its bottom end with said base and including a bracket to which a gas container is attachable, threaded means for attaching the gas container to said bracket, a burner assembly served by the gas container including a gas conduit and a heat reflector, and clamping means on said post structure for retention of said burner assembly in a detachable manner on said post structure.

2. The heater claimed in claim 1 wherein said base is cylindrical.

3. The heater claimed in claim 1 wherein said post structure is of angulated shape including an inclined segment, an upright segment and a horizontal segment to position said heat reflecter in vertically spaced relationship to said base.

4. The gas fired space heater claimed in claim 1 wherein said burner assembly includes a flow control valve.

5. The gas fired space heater claimed in claim 1 wherein said bracket supports multiple gas containers, said burner assembly includes a flow control valve in communication with the gas containers.

6. A gas fired space heater for an inhabitable mobile structure comprising, a base, a post structure on said base including a bracket to which a gas container is attached, a burner assembly on said post structure, a conduit communicating said container with the burner assembly, and said base of upright elongate shape insertable into a correspondingly shaped receptacle of the inhabitable mobile structure.

7. The heater claimed in claim 6 wherein said base is cylindrical.

8. The heater claimed in claim 4 wherein said post structure is of angular configuration including upright and horizontal segments offseting the gas container from the burner assembly.

9. The heater claimed in claim 6 wherein said post structure includes a holder engageable with said burner assembly, adjustable clamping means for securing the burner assembly in place on said holder in a detachable manner.

* * * * *